US007013866B1

(12) United States Patent
Prucka et al.

(10) Patent No.: US 7,013,866 B1
(45) Date of Patent: Mar. 21, 2006

(54) AIRFLOW CONTROL FOR MULTIPLE-DISPLACEMENT ENGINE DURING ENGINE DISPLACEMENT TRANSITIONS

(75) Inventors: Michael J Prucka, Grass Lake, MI (US); Gregory L Ohl, Ann Arbor, MI (US); Zhong Li, Westland, MI (US); Mark J Duty, Goodrich, MI (US); Eugenio DiValentin, Brighton, MI (US); Michael A Bonne, Leonard, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 11/087,443

(22) Filed: Mar. 23, 2005

(51) Int. Cl.
*F02D 13/04* (2006.01)

(52) U.S. Cl. ..... 123/319

(58) Field of Classification Search ..... 123/330, 123/334, 349, 350, 361, 319, 395, 184.21, 123/198 F, 481, 493, 399, 402; 701/103, 701/110

See application file for complete search history.

(56) References Cited

U.S. PATENT DOCUMENTS 4,967,727 A * 11/1990 Takahashi et al. ..... 123/481
5,113,823 A * 5/1992 Iriyama ..... 123/399
5,190,013 A * 3/1993 Dozier ..... 123/481
5,408,974 A 4/1995 Lipinski et al.
5,437,253 A * 8/1995 Huffmaster et al. ..... 123/399
5,568,795 A 10/1996 Robichaux et al.
5,806,012 A 9/1998 Maki et al.
5,839,409 A 11/1998 Denz et al.
5,970,943 A 10/1999 Robichaux et al.
6,311,670 B1 11/2001 Constancis
6,360,713 B1 3/2002 Kolmanovsky et al.
6,615,804 B1 9/2003 Matthews et al.
6,655,353 B1 12/2003 Rayl
6,687,602 B1 * 2/2004 Ament ..... 701/110
6,701,890 B1 * 3/2004 Suhre et al. ..... 123/350
6,736,108 B1 5/2004 Rayl et al.
6,752,121 B1 6/2004 Rayl et al.
6,782,865 B1 8/2004 Rayl et al.
6,843,752 B1 1/2005 Bolander (Continued)

OTHER PUBLICATIONS

Bates, B.; Dosdall, J. M.; and Smith, D. H.; "Variable Displacement by Engine Valve Control," SAE Paper No. 780145 (New York, NY; 1978).

(Continued)

*Primary Examiner*—Thomas Moulis
(74) *Attorney, Agent, or Firm*—Ralph E. Smith

(57) ABSTRACT

A method for controlling airflow in an intake manifold of a multiple-displacement engine during an engine displacement mode transition includes determining, before a displacement mode transition, a post-transition mass air flow rate necessary to maintain a pre-transition engine torque output, as well as an airflow transient multiplier based on engine speed and an estimated post-transition manifold air pressure. After multiplying the requested mass air flow rate with the transient multiplier, the resulting compensated requested mass air flow rate is divided by a maximum mass air flow rate to obtain a requested percent airflow. The percent airflow is thereafter used with engine speed to determine a requested post-transition manifold air pressure-to-barometric pressure ratio, for example, using a lookup table; and the requested post-transition pressure ratio is used to determine a transient post-transition throttle position, to which an engine throttle will be moved upon initiating the displacement mode transition.

8 Claims, 1 Drawing Sheet

U.S. PATENT DOCUMENTS

| | | | |
|---|---|---|---|
| 2002/0157640 | A1 | 10/2002 | Matthews et al. |
| 2002/0162540 | A1 | 11/2002 | Matthews et al. |
| 2004/0244744 | A1 | 12/2004 | Falkowski et al. |
| 2004/0244751 | A1 | 12/2004 | Falkowski et al. |

OTHER PUBLICATIONS

Mueller, Robert S.; and Uitvlugt, Martin W.; "Valve Selector Hardware," SAE Publication No. 780146 (New York, NY; 1978).

Fukui, Toyoaki; Nakagami, Tatsuro; Endo, Hiroyasu; Katsumoto, Takehiko; and Danno, Yoshiaki; "Mitsubishi Orion-MD-A New Variable Displacement Engine," SAE Paper No. 831007 (New York, NY; 1983).

Hatano, Kiyoshi; Iida, Kazumasa; Higashi, Hirohumi; and Murata, Shinichi; "Development of a New Multi-Mode Variable Valve Timing Engine," SAE Paper No. 930878 (New York, NY; 1993).

McElwee, Mark; and Wakeman, Russell; "A Mechanical Valve System with Variable Lift, Duration, and Phase Using a Moving Pivot," SAE Paper No. 970334 (New York, NY; 1997).

Yacoub, Yasser; and Atkinson, Chris; "Modularity in Spark Ignition Engines; A Review of its Benefits, Implementation and Limitations," SAE Publication No. 982688 (New York, NY; 1998).

Zheng, Quan; "Characterization of the Dynamic Response of a Cylinder Deactivation Valvetrain System," SAE Publication No. 2001-01-0669 (New York, NY; 2001).

Leone, T.G.; and Pozar, M.; "Fuel Economy Benefit of Cylinder Deactivation-Sensitivity to Vehicle Application and Operating Constraints," SAE Paper No. 2001-01-3591 (New York, NY; 2001).

Patton, Kenneth J.; Sullivan, Aaron M.; Rask, Rodney B.; and Theobald, Mark A.; "Aggregating Technologies for Reduced Fuel Consumption: A Review of the Technical Content in the 2002 National Research Council Report on CAFÉ," SAE Paper No. 2002-01-0628 (New York, NY; 2002).

Falkowski, Alan G.; McElwee, Mark R.; and Bonne, Michael A.; "Design and Development of the Daimlerchrysler 5.71 Hemi Engine Multi -Displacement Cylinder Deactivation System," SAE Publication No. 2004-01-2106 (New York, NY, May 7, 2004).

2004 Global Powertrain Congress program, Sep. 28-30, 2004, Ford Conference & Event Center, Dearborn, Michigan, USA (9 pages).

Albertson, William, et al [William Albertson, Thomas Boland, Jia-shium Chen, James Hicks, Gregory P. Matthews, Micke McDonald, Sheldon Plaxton, Allen Rayl, Frederick Rozario], "Displacement on Demand for Improved Fuel Economy Without Compromising Performance in GM's High Value Engines," Powertrain International -- 2004 Global Powertrain Conference, Saline, Michigan, Sep. 29, 2004.

* cited by examiner

AIRFLOW CONTROL FOR MULTIPLE-DISPLACEMENT ENGINE DURING ENGINE DISPLACEMENT TRANSITIONS

FIELD OF THE INVENTION

The invention relates generally to methods for controlling the operation of a multiple-displacement internal combustion engine, for example, used to provide motive power for a motor vehicle.

BACKGROUND OF THE INVENTION

The prior art teaches equipping vehicles with "variable displacement," "displacement on demand," or "multiple displacement" internal combustion engines in which one or more cylinders may be selectively "deactivated," for example, to improve vehicle fuel economy when operating under relatively low-load conditions. Typically, the cylinders are deactivated through use of deactivatable valve train components, such as the deactivating valve lifters as disclosed in U.S. patent publication No. U.S. 2004/0244751 A1, whereby the intake and exhaust valves of each deactivated cylinder remain in their closed positions notwithstanding continued rotation of their driving cams. Combustion gases are thus trapped within each deactivated cylinder, whereupon the deactivated cylinders are said to operate as "air springs" while the reduced number of active cylinders operates at a relatively-increased manifold air pressure, with a correlative reduction in engine pumping losses during subsequent engine operation in a partial-displacement engine operating mode. In the meantime, the prior art teaches quickly moving the throttle plate to a post-transition position calculated to provide the requisite mass air flow with which the engine can generate a post-transition torque output roughly matching the pre-transition engine torque output, while fuel and spark is adjusted immediately before and during the transition to further "smooth" torque variations generated during cylinder deactivation.

Upon cylinder deactivation, however, there is a "negative work" component associated with the recompression of the spent combustion gases trapped in the deactivated cylinders, thereby generating additional engine load that must be accommodated in order to prevent a torque disturbance perceptible to the driver. This compression work typically diminishes over several engine cycles as the deactivated cylinders and piston ring packs begin to cool, and as a quantity of such trapped gases blows by the ring packs.

BRIEF SUMMARY OF THE INVENTION

In accordance with an aspect of the invention, a method for controlling airflow in an intake manifold of a multiple-displacement engine during an engine displacement mode transition, for example, when transitioning between a full-displacement engine operating mode and a partial-displacement engine operating mode, includes determining, before a displacement mode transition, a requested post-transition mass air flow rate that will maintain the engine's pre-transition engine torque output, and an airflow transient multiplier by which, for example, additional air is delivered to the engine's pre-transition active cylinders to thereafter compensate for loss upon cylinder deactivation. In a preferred method, the airflow transient multiplier is determined based on a detected engine speed and an estimate of the post-transition manifold air pressure, with the latter estimate itself being determined by multiplying a detected or determined pre-transmission manifold air pressure with a conversion factor base d on the number of active cylinders before and after the transition, respectively.

The method also includes multiplying the requested mass air flow rate by the transient multiplier to obtain a compensated requested mass air flow rate; calculating a requested percent airflow using the requested mass air flow rate and a maximum mass air flow rate for the engine at the detected engine speed; and determining a requested post-transition manifold air pressure-to-barometric pressure ratio based on the requested percent airflow and the detected engine speed.

In accordance with an aspect of the invention, where the engine employs an electronic throttle body in which a throttle plate is electrically moved to a desired throttle position in response to a controller, the requested post-transition pressure ratio is thereafter used to determine a transient post-transition throttle position; and the throttle plate is moved to the transient post-transition throttle position upon initiating the displacement mode transition. It will be appreciated that the invention is suitable for use with a "throttleless" engine, in which the timing of the intake valves of the active cylinders is adjusted to thereby specify the air charge in each such cylinder; and that, in such engines, the invention contemplates using the requested post-transition pressure ratio to specify valve timing upon initiating an engine displacement mode transition.

In accordance with another aspect of the invention, the method preferably further includes changing spark timing and the amount of fuel supplied to the cylinders that are to remain active after the transition, from a time not earlier than moving the throttle plate, to thereby roughly match engine output torque generated during the transition with the engine output torque immediately prior to initiating the transition, and to correlatively reduce engine speed variation that might otherwise occur during the transition. It is noted that retarding spark advantageously serves to reduce pressure in the cylinders about to be deactivated during the transition, with an attendant reduction in the resulting "negative" transient compression work required over the.

In accordance with yet another aspect of the invention, the method preferably includes continuing to multiply subsequent values for a post-transition mass air flow rate by the transition multiplier for a predetermined period after initiating the displacement mode transition. The time period, which is preferably itself determined using empirical values stored in a lookup table and retrieved as a function of the detected engine speed immediately prior to the displacement mode transition, is preferably an event-based time measure, defined in terms of a number of engine cycles occurring since initiating the displacement mode transition.

Other objects, features, and advantages of the present invention will be readily appreciated upon a review of the subsequent description of the preferred embodiment and the appended claims, taken in conjunction with the accompanying Drawings.

DETAILED DESCRIPTION OF THE INVENTION

Figure 1:
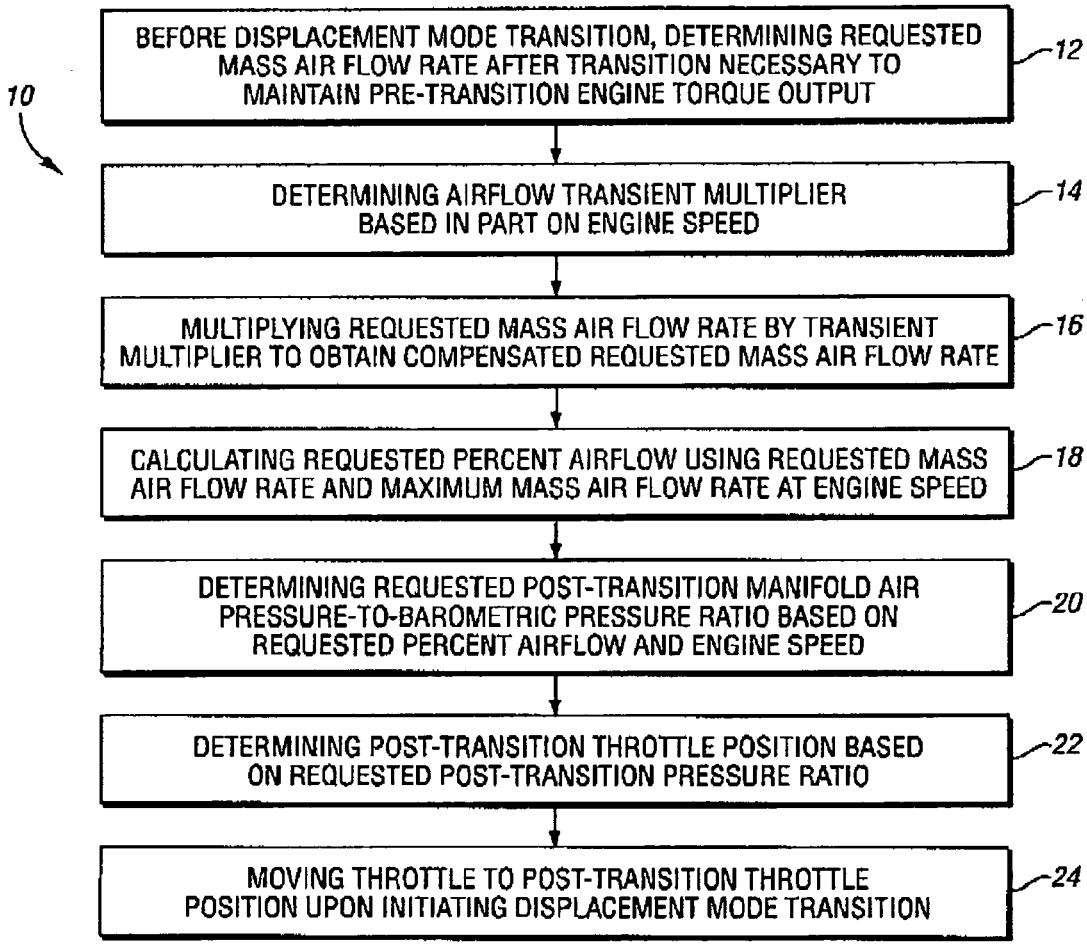
FIG. 1 is a flow chart illustrating the main steps of a method in accordance with an aspect of the invention a method for controlling airflow in an intake manifold of a multiple-displacement internal combustion engine during an engine displacement mode transition.

A method 10 for controlling airflow in an intake manifold of a multiple-displacement internal combustion engine during an engine displacement mode transition, for example, when transitioning between a full-displacement engine operating mode and a partial-displacement engine operating mode, is generally illustrated in FIG. 1. While the invention contemplates any suitable hydraulic and/or electro-mechanical systems for deactivating the given cylinder, including deactivatable valve train components, an exemplary method is used in controlling airflow in an eight-cylinder engine in which four cylinders are selectively deactivated through use of deactivatable valve lifters as disclosed in U.S. patent publication No. U.S. 2004/0244751 A1, the teachings of which are hereby incorporated by reference.

As seen in FIG. 1, the method 10 generally includes determining, at block 12, before a displacement mode transition, a requested post-transition mass air flow rate that will maintain the engine's pre-transition engine torque output; and further determining, at block 14, an airflow transient multiplier by which additional air is made available to the engine's pre-transition active cylinders. While the invention contemplates determining the airflow transient multiplier in any appropriate manner, in a preferred method, the airflow transient multiplier is determined based on a detected engine speed and an estimate of the post-transition manifold air pressure, as described below in connection with FIG. 3.

Referring again to FIG. 1, at block 16, the requested mass air flow rate is multiplied by the transient multiplier to obtain a compensated requested mass air flow rate. At block 18, a requested percent airflow is calculated by dividing the requested mass air flow rate with a measure representing a maximum mass air flow rate for the engine at the detected engine speed. And, at block 20, a requested post-transition manifold air pressure-to-ambient barometric pressure ratio is determined based on the requested percent airflow and the detected engine speed. Finally, at block 22, the requested post-transition pressure ratio is thereafter used to determine a transient post-transition throttle position.

At block 24 of FIG. 1, the throttle plate is moved to the determined transient post-transition throttle position upon initiating the displacement mode transition. It will be appreciated that the invention contemplates waiting a desired number of engine cycles, after moving the throttle plate, before deactivating or reactivating the engine cylinders, to thereby accommodate the lag in manifold air pressure change within the engine's air intake system responsive to a change in throttle position. Spark timing and the amount of fuel supplied to the cylinders that are to remain active after the transition are preferably adjusted to ensure a level of torque matching that is generally imperceptible to the vehicle driver. And, when transitioning from a full-displacement engine operating mode to a partial-displacement engine operating mode, spark is preferably retarded to advantageously reduce pressure in the cylinders about to be deactivated, whereupon the resulting "negative" transient compression work associated with the transition is beneficially reduced.

In accordance with yet another aspect of the invention, subsequent values for a post-transition mass air flow rate are preferably multiplied by the transition multiplier for a predetermined period after initiating the displacement mode transition, to overcome the transient compression work for its nominal duration. The time period, which is preferably itself determined using empirical values stored in a lookup table and retrieved as a function of the detected engine speed immediately prior to the displacement mode transition, is preferably an event-based time measure, defined in terms of a number of engine cycles occurring since initiating the displacement mode transition.

Significantly, in accordance with another aspect of the invention, because the application of the airflow transient multiplier is event-based, in the preferred method, the airflow transient multiplier is applied as a step function, without any "ramp up" or "ramp down," with spark timing and supplied fuel being adjusted to achieve the desired output torque matching during and immediately after the transition.

Figure 2:
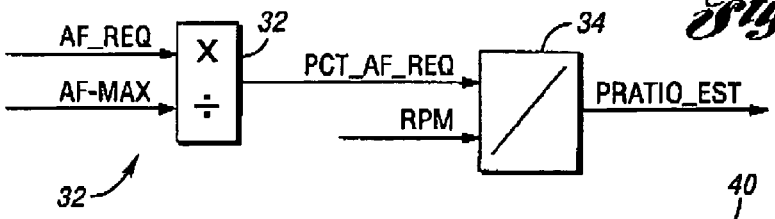
FIG. 2 shows an exemplary computer-executable process for estimating an ratio of post-transition manifold air pressure-to-ambient barometric pressure, for use in practicing the invention.

Referring to FIG. 2, in a first exemplary computer-executable process 30 in accordance with the invention, the requested post-transition manifold air pressure-to-ambient barometric pressure ratio PRATIO_EST is determined by dividing the requested mass air flow rate AF_REQ by an engine-speed-based measure of maximum airflow AF_MAX at multiplier 32. The resulting requested percent airflow PCT_AF_REQ is supplied with the detected engine speed RPM to a lookup table 34, to thereby provide to thereby retrieve the desired value PRATIO_EST for the requested post-transition manifold air pressure-to-ambient barometric pressure ratio.

Figure 3:
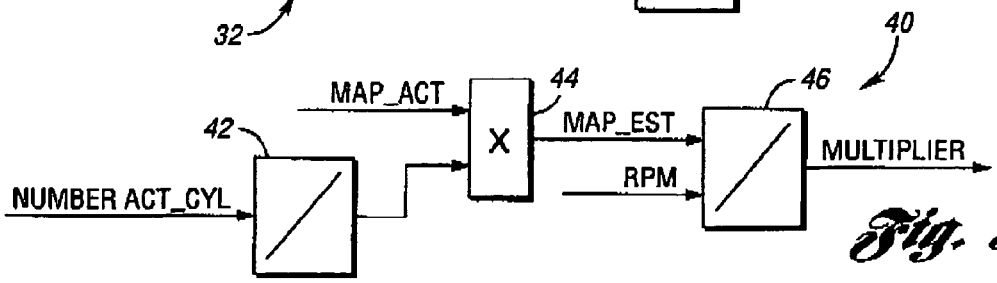
FIG. 3 shows an exemplary computer-executable process for generating an airflow transient multiplier, in accordance with another aspect of the invention.

Referring to FIG. 3, in a second exemplary computer-executable process 40 in accordance with the invention, a lookup table 42 supplies a multiplier reflecting the typically generally-linear relationship between the number of active cylinders with which the engine is operating, and the achieved manifold air pressure, based on the number of pre-transition active cylinders NUMBER_ACT_CYL. The output of the lookup table 42 is supplied with a detected or determined measure of the pre-transition manifold air pressure MAP_ACT to multiplier 44, and the resulting estimate of post-transition manifold air pressure MAP_EST is supplied with a detected pre-transition engine speed RPM to another lookup table 46, to thereby retrieve a desired value MULTIPLIER for the airflow transient multiplier.

While the above description constitutes the preferred embodiment, it will be appreciated that the invention is susceptible to modification, variation and change without departing from the proper scope and fair meaning of the subjoined claims.

What is claimed is:

1. A method for controlling airflow in an intake manifold of a multiple-displacement engine during an engine displacement mode transition, the method comprising:

determining, before a displacement mode transition, a requested mass air flow rate after the transition necessary to maintain a pre-transition engine torque output;

determining an airflow transient multiplier based in part on a detected engine speed;

multiplying the requested mass air flow rate by the transient multiplier to obtain a compensated requested mass air flow rate;

calculating a requested percent airflow using the requested mass air flow rate and a maximum mass air flow rate for the engine at the detected engine speed;

determining a requested post-transition manifold air pressure-to-barometric pressure ratio based on the requested percent airflow and the detected engine speed;

determining a transient post-transition throttle position based on the requested post-transition pressure ratio; and moving a throttle plate of a throttle body to the transient post-transition throttle position upon initiating the displacement mode transition.

2. The method of claim 1, wherein determining the transient multiplier includes providing a pre-transition manifold air pressure, and estimating a post-transition manifold air pressure based on the pre-transition manifold air pressure.

3. The method of claim 2, wherein estimating the post-transition manifold air pressure includes multiplying the pre-transmission manifold air pressure with a conversion factor, the conversion factor representing a volumetric ratio of the pre-transition engine displacement and the post-transition engine displacement.

4. The method of claim 3, wherein the conversion factor is based on a number of engine cylinders that are active prior to the displacement mode transition and a number of engine cylinders that are active after the displacement mode transition.

5. The method of claim 1, further including retarding an engine spark timing not earlier than moving the throttle plate.

6. The method of claim 1, further including increasing, not earlier than moving the throttle plate, a supply of fuel to a number of engine cylinders that are active after the displacement mode transition.

7. The method of claim 1, including continuing to multiply subsequent values for a post-transition mass air flow rate by the transition multiplier for a predetermined period after initiating the displacement mode transition.

8. The method of claim 7, wherein the predetermined period is determined as a function of the detected engine speed immediately prior to the displacement mode transition.

* * * * *